US006554761B1

(12) United States Patent
Puria et al.

(10) Patent No.: US 6,554,761 B1
(45) Date of Patent: Apr. 29, 2003

(54) FLEXTENSIONAL MICROPHONES FOR IMPLANTABLE HEARING DEVICES

(75) Inventors: Sunil Puria, Mountain View, CA (US); Rodney C. Perkins, Woodside, CA (US)

(73) Assignee: Soundport Corporation, Palo Alto, CA (US)

( * ) Notice: Subject to any disclaimer, the term of this patent is extended or adjusted under 35 U.S.C. 154(b) by 0 days.

(21) Appl. No.: 09/429,894

(22) Filed: Oct. 29, 1999

(51) Int. Cl.[7] ..... H04R 25/00

(52) U.S. Cl. ..... 600/25; 381/326; 381/114

(58) Field of Search ..... 381/173, 190, 381/114, 326; 600/25; 607/55–57

(56) References Cited

U.S. PATENT DOCUMENTS

| | | | | | |
|---|---|---|---|---|---|
| 5,277,694 | A | * | 1/1994 | Leysieffer et al. | 181/130 |
| 5,440,237 | A | * | 8/1995 | Brown et al. | 324/130 |
| 5,531,787 | A | | 7/1996 | Lesinski et al. | |
| 5,558,618 | A | * | 9/1996 | Maniglia | 600/25 |
| 5,729,077 | A | | 3/1998 | Newnham et al. | |
| 5,762,583 | A | * | 6/1998 | Adams et al. | 600/25 |
| 5,772,575 | A | | 6/1998 | Lesinski et al. | |
| 5,782,744 | A | | 7/1998 | Money | |
| 5,788,711 | A | | 8/1998 | Lehner et al. | |
| 5,804,907 | A | | 9/1998 | Park et al. | 310/358 |
| 5,814,095 | A | | 9/1998 | Müller et al. | 607/57 |
| 5,836,863 | A | | 11/1998 | Bushek et al. | |
| 5,842,967 | A | | 12/1998 | Kroll | |
| 5,859,916 | A | | 1/1999 | Ball et al. | |
| 5,879,283 | A | * | 3/1999 | Adams et al. | 181/135 |
| 5,900,274 | A | * | 5/1999 | Chatterjee et al. | 29/25.35 |
| 6,050,933 | A | | 4/2000 | Bushek et al. | |
| 6,068,589 | A | * | 5/2000 | Neukermans | 600/25 |

OTHER PUBLICATIONS

Dogan, A. (1994). "Flextensional 'moonie and cymbal' actuators," Ph.D. thesis, The Pennsylvania State University, UMI Co.: Ann Arbor, MI., pp. 1–181.

Huddle, H. et al. (1998). "Measuring and modeling basic properties of the human middle ear and ear canal. Part III: Eardrum impedances, transfer functions and model calculations," *Acustica–acta acustica* 84:1091–1108.

Kemp, D. T. (1978). "Stimulated acoustic emissions from within the human auditory system," *J. Acoust. Soc. Am.* 64(5):1386–1391.

Killion, M. C. (Dec. 1997). "SNR loss: 'I can *hear* what people say but I can't *understand* them'," *The Hearing Review* 4:8–14.

(List continued on next page.)

*Primary Examiner*—Max F. Hindenburg
*Assistant Examiner*—Joseph A. Cadugan
(74) *Attorney, Agent, or Firm*—Morrison & Foerster LLP

(57) ABSTRACT

This relates to flextensional microphones which are made up of a piezoelectric substrate having opposing surfaces, typically parallel surfaces when the substrate is crystalline or ceramic, and at least one sound receiving surface physically tied to the piezoelectric substrate. The microphones are at least partially isolated via a biocompatible material, e.g., by a covering or a coating. The inventive microphones may be subcutaneously implanted. The microphones may be used as components of surgically implanted hearing aid systems or as components of hearing devices known as cochlear implants. Preferably the microphones are used in arrays and when used as a component of a hearing assistance or replacement device, are used in conjunction with a source of feedback information, usually another microphone. The feedback information usually relates to sound re-emitted from physical portions of the ear, e.g., the eardrum, where those portions have been directly or indirectly driven by the actuator of the implanted hearing aid.

73 Claims, 12 Drawing Sheets

OTHER PUBLICATIONS

Kodera, K. et al. (1988). "Evaluation of the implantable microphone in the cat," *Adv. Audiol.* 4:117–123.

Puria, S. et al. (1996). "Measurement of reverse transmission in the human middle ear: Preliminary results," *In Diversity in Auditory Mechanics*. E. R. Lewis et al. eds., World Scientific: Singapore, pp. 151–157.

Puria, S. et al. (May 1997). "Sound–pressure measurements in the cochlear vestibule of human–cadaver ears," *J. Acoust. Soc. Am.* 101(5):2754–2770.

Schuchman, G. et al. (Jul. 1999). "User satisfaction with an ITE directional hearing instrument," *The Hearing Review* 6:12–23.

Tressler, S. F. (1997). "Capped ceramic underwater sound projector: The 'cymbal', " Ph.D. thesis, The Pennsylvania State University, UMI Co.: Ann Arbor, MI., pp. 1–295.

Xu, Q. C. et al. (Nov. 1991). "Piezoelectric composites with high sensitivity and high capacitance for use at high pressures," *IEEE Transactions on Ultrasonics, Ferroelectrics, and Frequency Control* 38(6):634–639.

* cited by examiner

FLEXTENSIONAL MICROPHONES FOR IMPLANTABLE HEARING DEVICES

FIELD OF THE INVENTION

This invention relates to flextensional microphones which are made up of a piezoelectric substrate having opposing surfaces, typically parallel surfaces when the substrate is crystalline or ceramic, and at least one sound receiving surface physically tied to the piezoelectric substrate. The microphones are at least partially isolated via a biocompatible material, e.g., by a covering or a coating. The inventive microphones may be subcutaneously implanted. The inventive microphones may be used as components of surgically implanted hearing aid systems or as components of hearing devices known as cochlear implants. Preferably the microphones are used in arrays and when used as a component of a hearing assistance or replacement device, are preferably used in conjunction with a source of feedback information, preferably another microphone. The feedback information usually relates to sound re-emitted from physical portions of the ear, e.g., the eardrum, where those portions have been directly or indirectly driven by the actuator of the implanted hearing aid.

BACKGROUND OF THE INVENTION

For an implantable hearing device to transmit acousto-mechanical signals to the middle-ear or the inner ear, or electrical signals to an inner ear electrode, a microphone is needed to sense environmental sounds. To make the hearing device fully implantable, the microphone and associated wiring must be placed under the skin. Subcutaneous placement of the microphone allows the entire hearing device, i.e., that microphone, the output transducer, the battery, and associated sound processor to be implanted entirely inside the body. Fully implanted hearing devices have the important cosmetic advantage of being entirely invisible.

The inventive microphones may also be used as a component of a partially implantable hearing aid system. In a typical partially implantable hearing aid, the microphone and output transducer are implanted in the body but the power supply and sound-processing electronics are outside the body. Communication from the microphone sound processor is achieved with implanted coils using RF techniques.

Others have proposed implanting microphones into the body as a part of a hearing aid. Several microphone implantation methods have been proposed. These devices fall into two generic classes. In the first such class, the microphone is implanted subcutaneously. In the other group, the microphone is placed outside the skin and the signal is sent trans-cutaneously by a pair of coils. Our inventive microphones are generally used as subcutaneous microphones, although obviously, they have other uses.

In the first noted class of hearing aids, those using subcutaneous microphones, the transducers fall into at least four basic categories. In the first, a commercially available electret microphone is used. The electret microphone is encased and sealed in an acoustic chamber thereby making it compatible for implantation in tissue. This approach was originally described in: Kodera, K., Suzuki, K., and Ohno, T. (1988). "Evaluation of the implantable microphone in the cat," in Suzuki, J.-I., editor, *Middle Ear Implant: Implantable Hearing Aids*, pages 117–123. Karger, Basel. More recently, such a method is found in U.S. Pat. No. 5,814,095, to Willer et al. and in U.S. Pat. No. 5,859,916, to Ball et al.

In another method, the vibrations of the malleus are sensed by a piezo transducer. This approach is suggested in U.S. Pat. No. 5,531,787, to Lesinski et al.; U.S. Pat. No. 5,788,711, to Lehner et al.; U.S. Pat. No. 5,842,967, to Kroll; and U.S. Pat. No. 5,836,863, to Bushek et al.

In yet a third method, sound vibrations in the ear canal are sensed by a PVDF (Kynar) based piezo transducer placed in the concha. This approach is shown in U.S. Pat. No. 5,772,575, to Lesinski et al.

Finally, U.S. Pat. No. 5,782,744, to Money, describes a sensor placed in the middle ear cavity to transduce the sound produced by the eardrum, or in the cochlea to transduce the fluid pressure produced by stapes motion.

In each of these techniques, the sensing microphone has been placed in various locations within the auditory periphery.

None of these documents show the use of our inventive microphone and particularly not within the array or hearing device described herein.

SUMMARY OF THE INVENTION

The inventive microphone is an acousto-active device made up of an acousto-active substrate having a pair of opposed planar surfaces. The substrate, typically made from piezoelectric single crystals (SCP) or ceramics such as PZT, PLZT, PMN, PMN-PT, have a 3 direction orthogonal to the planar surface defined by the 1 and 2 directions parallel to the planar surfaces. These materials generate a voltage measurable between the two planar surfaces when the material is strained or stressed in at least one of said three directions. The coefficients of $d_{33}$, $d_{31}$ and $d_{32}$ commonly relate the induced voltage induced to the induced strain. In regards to the coefficient $d_{ij}$, the ij subscripts denote the orthogonal coordinate system. The substrate itself may be a single crystal, a single layer, or may be a multi-layer composite. Most preferred, the substrate is a single crystal. The substrate typically is generally circular although it need not be. In certain circumstances, the substrate may have at least one linear edge, e.g., it may be rectangular.

The acoustic stress is applied to the substrate by at least one stress-inducing member attached to the substrate. One of the stress-inducing members induces stress across at least one of the directions in the 1–2 planar surface having piezo coefficients $d_{31}$ or $d_{32}$ when a flat portion of the member is exposed to an acoustic pressure. Another stress-inducing member is also attached to the other side of the substrate, but it need not be a sound receiving member.

The microphone preferably is isolatable from the surrounding body using a biocompatible material, perhaps a covering, casing, or bag over at least a portion of the stress-inducing members. It is highly preferable that the substrate be capable of producing a detectable voltage across its planar surfaces when the first stress-inducing member is subjected to a sound in the audible frequency range (100 Hz–100 kHz), and levels of 40–120 dB corresponding to a microphone sensitivity of 0.2 mV/Pa to 50 mV/Pa and a noise figure of less than 40 dB SPL (Sound Pressure Level).

The system including the inventive transducer may further include a voltage receiver, e.g., a detector, an A/D converter, an amplifier, or the like, for receiving the voltage generated across the substrate surfaces when the stress-inducing members are exposed to sound or to vibrations due to sound. The voltage produced as a result of the stress applied to the substrate is measured across electrodes placed on the substrate surfaces. The electrodes may be independent, may be an adhesive affixing the stress-inducing members to the substrate, or may be the stress-inducing members themselves. The electrodes may be metallic or a conductive polymer.

The first or primary stress-inducing member generally includes a sound receiving diaphragm generally parallel to the adjacent substrate planar surface. The sound forces impinging on the sound receiving diaphragm are transmitted to the substrate via any of a number of structures. The preferred structure is a frusto-conical shell section (a "cymbal") further having an outer lip fixedly attached to the substrate. Other structures include frusto-hemispherical shell sections (a "moonie"), bridge shaped components having at least two linear spacing members attached both to the sound receiving diaphragm and to the substrate, and prismatoid shell sections. Other structures are also suitable.

The inventive device may be included in an array of microphones or used as a singlet. The preferred array is linear, i.e., the microphones are in a line and the sound receiving diaphragms all point in the same direction.

Furthermore, the inventive method for detecting audible sound typically comprises the steps of placing in the path of an audible sound, at least one inventive flextensional microphone that is at least partially isolated with a biocompatible coating. It is desirable that the microphone be subcutaneously implanted. It should produce a first electric signal related to the audible sound which is amplified and introduced to an output actuator coupled to a human ear component.

The flextensional microphones are preferably situated in an array to allow detection of the direction of a path of said audible sound.

It is also desirable to use an independent microphone situated so that it can hear sound re-radiated by an human ear component, e.g., the eardrum, and produce a feedback signal related to that re-radiated sound. The feedback signal is then compared to the signal sent from the microphone array and then is used to modify the amplified signal to produce a feedback-free signal for the output actuator.

DESCRIPTION OF THE INVENTION

The inventive microphone is based on the principles of flextensional design. Preferred are the "cymbal" or "moonie" transducers discussed in more detail below. Also preferred is the use of these inventive microphones as a subcutaneous component in a surgically implantable hearing aid system, cochlear implant system, or other related devices.

The preferred inventive microphones include a piezo element in a flextensional mode to sense the acoustic pressure of environmental sounds. The piezo substrate for the inventive microphone may be a single crystal piezo (SCP), or a ceramic, polymer or other type of piezo element. The substrate may be a composite as is discussed below.

In each variation of the invention, acoustic energy causes contractions and expansion of a piezoelectric transducer. For instance, the length, width, and height of a rectangular transducer, or the thickness and diameter of a disk-shaped transducer will vary in response to physical manipulation of that substrate via imposition of sonic energy to that substrate. The expansions and contractions in turn produce an electrical signal that is proportional to the applied force. That is to say: the diaphragm vibrates; the piezoelectric substrate vibrates; the piezoelectric substrate generates a voltage. This is based on the classical mechanical-to-electrical piezo property that was mathematically deduced from fundamental thermodynamic principles by Lipton in 1881.

Figure 1:
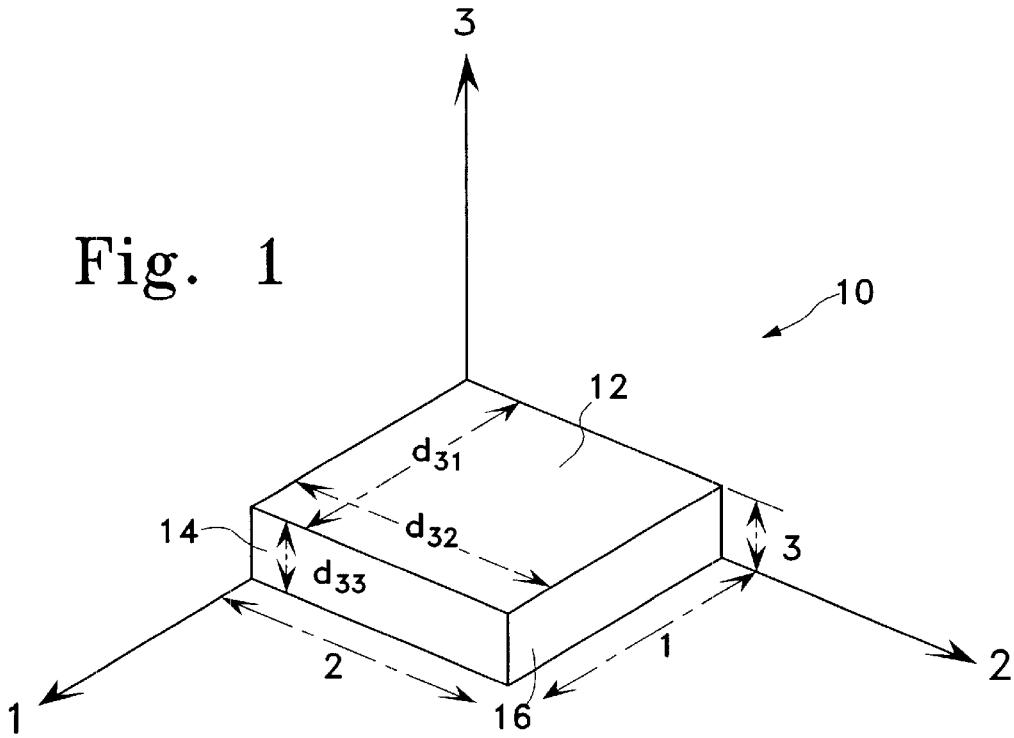
FIG. 1 shows a piezoelectric crystal and the conventions for naming the specific piezoelectric strain coefficients as related to an orthogonal coordinate system.

Derivable from constitutive laws that govern operation of piezo transducers, are the set of piezo constants $g_{mn}$ relating the electric field produced by a mechanical stress (g=open circuit electric field/applied mechanical stress) to that mechanical stress. The units are typically expressed as volts/meter per Newtons/square-meter. The output voltage is obtained by multiplying the calculated electric field g by the piezo thickness t ($V_0=g\cdot t$). These coefficients are a measure of the voltage generated across a surface (m) due to a given force in a specified direction (n). As is shown in FIG. 1, subscript "33" indicates that both the electric field and the mechanical stress are along the same polarization axis. A "31" subscript signifies that the pressure is applied at right angles to the polarization axis, with the voltage across the same electrodes as for the "33" case.

One way of increasing the sensitivity of piezo-metal or piezo-plastic or composite microphones is the use of a transducer based on flextensional designs. Flextensionals have existed since the 1920s and are made up of a piezoelectric sensor element sandwiched between two specially designed endcaps. The endcaps serve to mechanically amplify the forces and, consequently, the generative voltages of the piezos. A force in the axial direction of the endcaps allows both the $g_{31}$, and $g_{33}$ coefficients of the piezo element (again, see FIG. 1) to cooperate in producing a much larger electric field [$g_h=(g_{33}+g_{31})$] than is possible with just the piezo element. See, Xu, Q., Yoshikawa, S., Belsick, J., and Newnham, R. (1991). "Piezoelectric composites with high sensitivity and high capacitance for use at high pressures," *IEEE Transactions of Ultrasonics, Ferroelectrics, and Frequency Control* 38(6):634–639.

The shape of the endcaps or shells, to a large extent, determines this mechanical amplification. Two basic types, described in more detail below, are called the "cymbal" and the "moonie". The general design of these transducers may be found, e.g., in Dogan, A. (1994). *Flextensional 'moonie and cymbal' actuators.* Ph.D. thesis, The Pennsylvania State University; Tressler, J. F. (1997). *Capped ceramic underwater sound projector: The 'Cymbal'* Ph.D. thesis, The Pennsylvania State University; and in U.S. Pat. No. 5,729,077, to Newnham et al.

Clearly, one important advantage of these transducers is the potential for increase in the effective piezo constants (such as the figure of merit $g_h$) by an order of magnitude or more. In flextensional microphones, the force imparted by the acoustic signal on the endcaps or shells of the transducer is increased by the lever action or moment arm of the shell at the piezo sensor element. This mechanical advantage, combined with the use of certain SCP's results in effective overall values of $g_{31}$ and $g_{33}$, that are typically 3–4 times greater than ceramic piezo substrates (see U.S. Pat. No. 5,804,907 to Park et al.) and consequent generated voltages that are 30–40 times (about 30 dB) greater than other existing methods. This is an important advantage because the combined effect will be an increase in signal level for the same background noise (i.e., due to the electronics) and the resulting signal-to-noise ratio of the overall hearing device is greatly improved.

When implanting these inventive microphones below the skin, it is desirable to match the impedance of the microphone to the impedance of the surrounding tissue. Otherwise, the overall sensitivity of the device is compromised. Ceramic piezo transducers are more difficult to match due to their high impedance in comparison to the impedance of air. PVDF (Kynar) based microphones, on the other hand, are generally easier to match because the impedance of this material is very close to the impedance of fluid and body tissues. In general, the inventive microphones are tailored to have the impedance approximating that of tissue so that energy transfer through the skin is optimized. As will be noted below, the physical parameters of the endcaps or stress-inducing members of the inventive microphones are varied to provide such a match.

In one variation of the invention, the inventive microphone is implanted in the external ear canal, either between the malleus and the eardrum or between the skin and the temporal bone. In an implantable hearing aid application, sound is generated by the output actuator to drive the inner ear, or alternative the middle ear. It is well known that the middle ear provides a pressure gain from the ear-canal to the vestibule in forward direction. See, Puria, S., Peake, W., and Rosowski, J. (1997). "Sound-pressure measurements in the cochlear vestibule of human-cadaver ears," *J. Acoust. Soc. Am.* 101(5):2754–2770. It is also known that in the reverse direction the middle ear can transmit sounds that originate from the inner ear. See, Puria, S. and Rosowski, J. J. (1996). "Measurement of reverse transmission in the human middle ear: Preliminary results," in Lewis et al., T., editor, *Diversity in Auditory Mechanics.* World Scientific, as well as Hudde, H. and Engel, A. (1998). "Measuring and modeling basic properties of the human middle ear and ear canal. part III: Eardrum impedances, transfer functions and model calculations," *Acustica—acta acustica* 84:1091–11109. Otoacoustic emissions are evidence of this reverse sound transmission path. See, Kemp, D. T. (1978). "Stimulated acoustic emissions from within the human auditory system," *J. Acoust. Soc. Am.* 64:1386–1391. Under these circumstances, the eardrum acts as loudspeaker. Consequently, a microphone placed in the ear canal may result in acoustic feedback due to the presence of the output transducer of an implantable hearing aid. To further attenuate the feedback path from the eardrum to the microphone, it may be desirable that the microphones be placed as far away from the eardrum as possible. Thus, an advantage of microphones located outside the ear canal is a substantial reduction of feedback due to sound generated by the eardrum in the reverse direction.

Directional microphone technology may be used to improve the signal-to-noise ratio (SNR) for sounds emanating from a desired direction. Suitable directional microphone technology includes the use of microphones such as dual-port single-diaphragm microphone or two omnidirectional microphones with electronic delay or an array of omnidirectional microphones electronically arranged to provide beam forming. See, e.g., Soeda, W. (1990). *Improvement of Speech Intelligibility in Noise.* Ph.D. thesis, Delft University. ISBN 90-9003763-2 and Schuchman, G., Valente, M., Beck, L., and Potts, L. (1999). "User satisfaction with an ITE directional hearing instrument," *The Hearing Review* 6(7):12–23. For practical and cosmetic reasons, we prefer to place the microphone array outside the external ear canal and between the skin and the temporal bone.

Figure 2A:
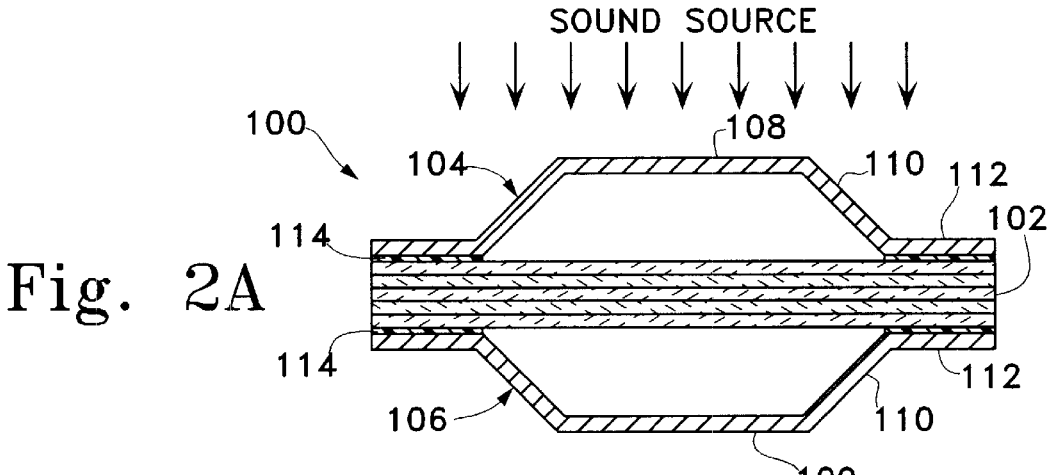
FIGS. 2A, 2B, and 2C show respectively cross-section side view, perspective view, and top view of one variation of the inventive device.
Figure 2B:
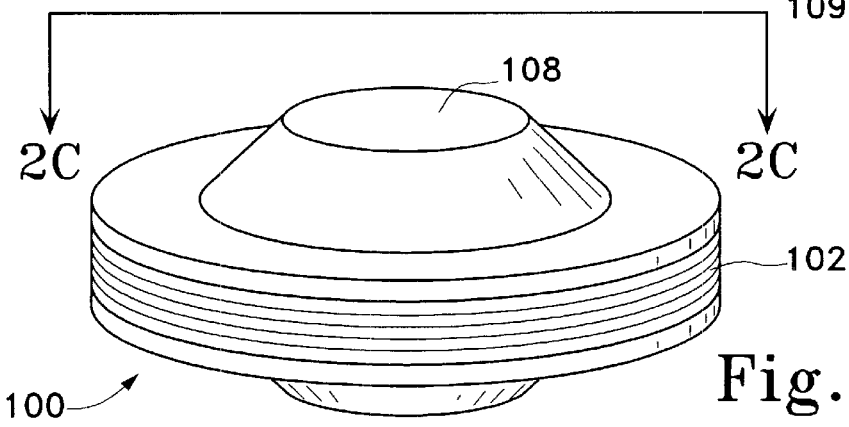
Figure 2C:
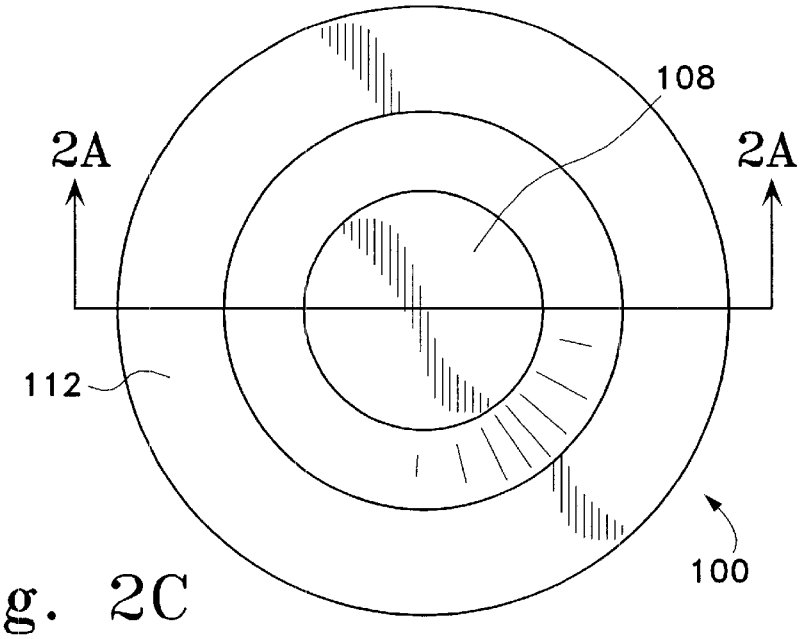

FIGS. 2A, 2B, and 2C show respectively side cross section, perspective, and top views of a first variation (100) of the inventive microphone. This is the shape we generally will refer to as the "cymbal" microphone. The substrate (102) is shown to be a multi layer composite of a ceramic piezoelectric material. As is noted elsewhere, the substrate (102) preferably comprises a SCP of a solid solution of lead-zinc-niobate/lead titanate or lead-magnesium-niobate/lead titanate, described by the formulae: $Pb(Zn_{1/3}Nb_{2/3})_{1-x}Ti_xO_3$ or $Pb(Mg_{1/3}Nb_{2/3})_{1-y}Ti_yO_3$; where $0 \leqq x < 0.10$ and $0 \leqq y < 0.40$. Other especially suitable materials include ceramics such as PZT, PLZT, PMN, PMN-PT and piezoelectric polymers such as PVDF, sold as Kynar. The substrate (102) in this variation has a pair of opposing planar surfaces. It is across these opposing surfaces where the resulting voltage may be found. The planar surfaces of the substrate (102) is adherent to at least a pair of stress-inducing members (104, 106). Typically, one of the stress-inducing members (e.g., 104) will be exposed to the sound to be detected by the hearing aid assembly. A stress-inducing members (104, 106) will typically be made up of a sound receiving diaphragm (108) separated from the substrate (102) by a frusto-conical section (110).

The stress-inducing members (104, 106) also typically have a lip (112) which transmits force from the sound receiving diaphragm (108) through the frusto-conical section (110) to the substrate (102). The stress-inducing members (104, 106) may be made of a variety of materials, e.g., metals and alloys such as brass, titanium, Ni/Ti alloys such as nitinol, etc. and polymers. Although a variety of polymers are suitable, engineering polymers are desired.

Further, at least a portion of the microphone, e.g., the stress-inducing members (104, 106) and the edges of the substrate, should be isolated from the surrounding body with a biocompatible material. Suitable materials include coatings or coverings of, e.g., titanium, titanium oxide, gold, platinum, vitreous carbon, and a number of other appropriate and known polymers. A polymeric, metallic, or composite bag of appropriate size and composition is also appropriate. Care is taken not to short-circuit the two planar surfaces of the substrate with the isolating material.

The stress-inducing members (104, 106) may be glued to the substrate (102) by an adhesive (114). The adhesive, preferably those sold as CRYSTAL BOND and MASTER BOND (sold by Emerson and Cuming), may be used as the electrodes for picking up the resulting electrical signal by including, e.g., powdered metals, in the adhesive layer (114). The stress-inducing members (104, 106) may similarly be used as those electrodes.

It should be noted that stress-inducing member (104) need not be the same physical shape as stress-inducing member (106). Stress-inducing member (104) "sees" the impinging sound (depicted by the direction arrows in FIG. 2A) and, when the device is implanted, the backside stress-inducing member (106) is not necessarily in the path of the sound. The stress-inducing member (106) need not, for instance, have the same size diaphragm (109). Indeed, in some variations, it need not have a planar diaphragm (109) at all.

The components of stress-inducing member (104) are optimized to maximize the resulting pressure imposed upon the substrate (102). For instance, the planar diaphragm (108) may be maximized in size or in diameter in keeping with the goal of maximizing radial displacement in the plane of the substrate (102).

Typically, the size of the inventive microphone is less than 5 mm but is not limited to this dimension.

FIGS. 2B and 2C show that the overall shape of this variation of the device is circular.

Figure 3A:
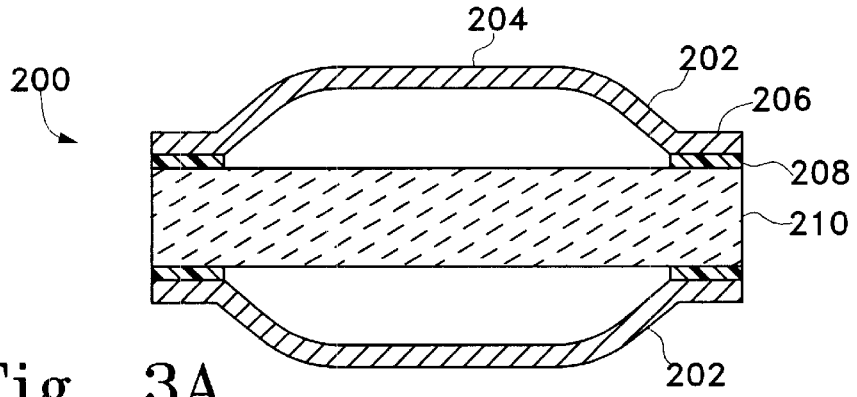
FIGS. 3A and 3B show respectively cross-section side views of hemispherical variations of the inventive device.

FIG. 3A shows a cross section side view of an additional variation (200) of the inventive microphone. The main components of the device are substantially the same as was the case with the variation shown in FIGS. 2A, 2B, and 2C, with the exception of the spacer lever arm (202) between planar diaphragm (204) and peripheral lip (206). The adhesive (208) is also shown between lip (206) and piezoelectric substrate (210). It should be noted that the substrate (210) is depicted as a single crystal. A single crystal of a solid solution of lead-zinc-niobate/lead titanate or lead-magnesium-niobate/lead titanate, described by the formulae: $Pb(Zn_{1/3}Nb_{2/3})_{1-x}\ Ti_xO_3$ or $Pb(Mg_{1/3}Nb_{2/3})_{1-y}\ Ti_yO_3$ is the most preferred piezoelectric substrate (210). Other especially suitable materials include ceramics such as PZT, PLZT, PMN, PMN-PT and piezoelectric polymers such as polyvinylidenefluoride (PVDF), sold as KYNAR.

Figure 3B:
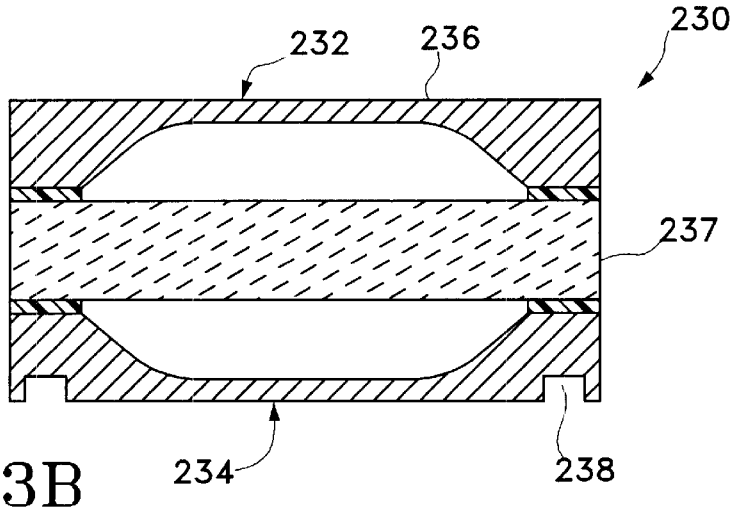

FIG. 3B shows a cross section, side view of an additional variation (230) of the inventive microphone. Again, the main components of the device are substantially the same as was the case with the variation shown in FIGS. 2A, 2B, and 2C. However, the caps or stress-inducing members (232, 234) are of a different design. Stress-inducing member (232) is a relatively solid section with a dome-shaped cavern inside adjacent the substrate (236) surface. This variation has a very large planar diaphragm (236). Another variation of the stress-inducing member (234) is similar to stress-inducing members (232) but has a groove (238) included for the purpose of rendering the stress-inducing members (234) somewhat more flexible than its cousin stress-inducing member (232). In a single device, either of the stress-inducing members (232, 234) may have either design or both may be the same.

Figure 4A:
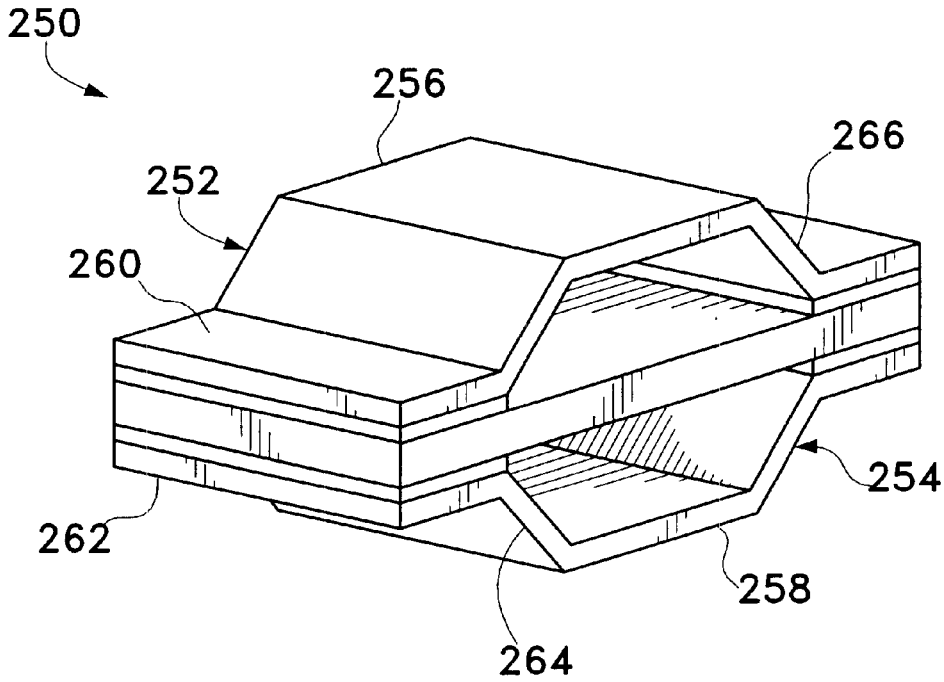
FIGS. 4A and 4B show perspective views of two variations of the inventive device having bridge-like endcaps.

FIG. 4A shows a perspective view of still an additional variation (250) of the inventive microphone. In this variation, the transducer is rectangular, perhaps square. The stress-inducing members (252, 254) are bridge-like, and open on the sides. The respective planar diaphragms (256, 258) similarly have one or more linear sides and are separated from the adherent lips (260, 262) by spacer/lever arms (264, 266).

Figure 4B:
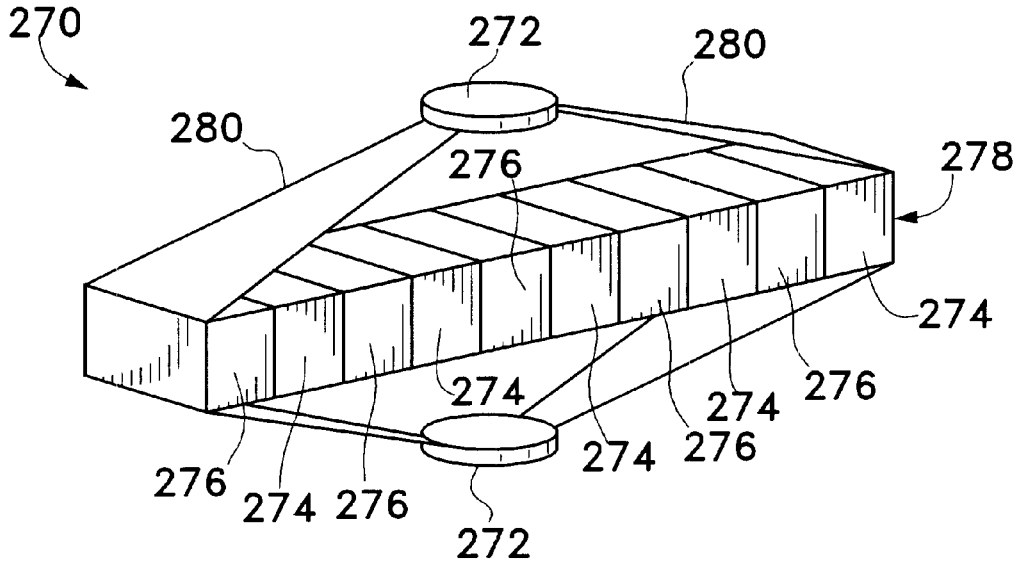

FIG. 4B shows a perspective view of an additional variation (270), referred to as the X-spring actuator, of the inventive microphone. In this variation, the transducer (270) has a plurality of stacked substrates (274) separated by complementary substrates (276). The substrates (274) and complementary substrates (276) are aligned to form a composite substrate (278). The planar regions (272) for intercepting audible sound are supported by arms (280) that are attached to the composite substrate (278).

Figure 5A:
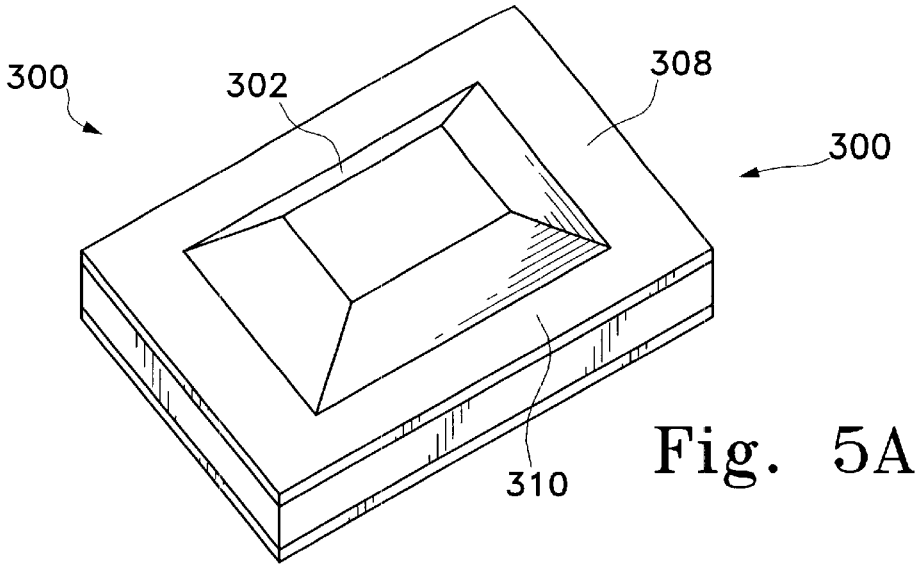
FIGS. 5A, 5B, 5C, and 5D show respectively perspective view, side view, end view, and top view of the prismatoid variation of the inventive device.
Figure 5B:
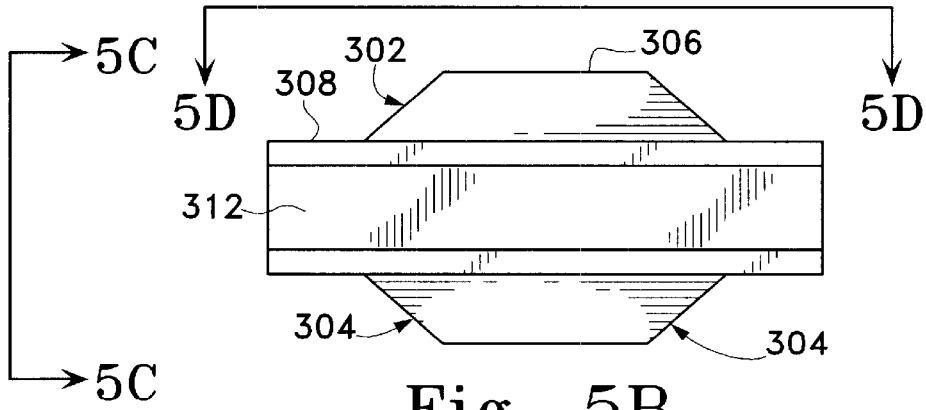
Figure 5D:
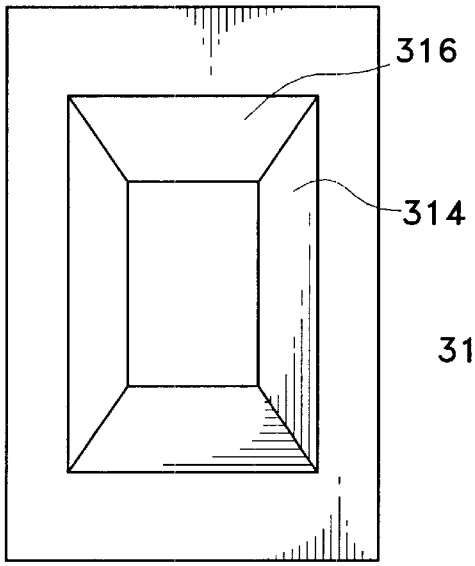
Figure 5C:
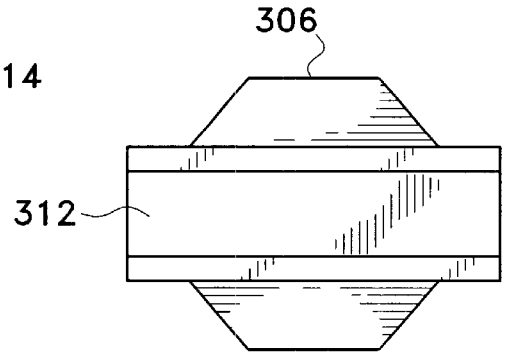

FIG. 5A shows another variation of the inventive flextensional microphone (300) having a pair of trapezoidal closed endcaps (302, 304). In this variation, endcap (302) has a planar surface of (306) and extending lips (308, 310) which adhere to the substrate (312). The endcaps (302, 304) are closed and contain a volume inside. The angle of the side panels (314) and (316) may be altered to, e.g., variously maximize the size of the planar diaphragm (306) or enhance the mechanical advantage of the planar diaphragm (306) with respect to substrate (312).

Figure 6A:
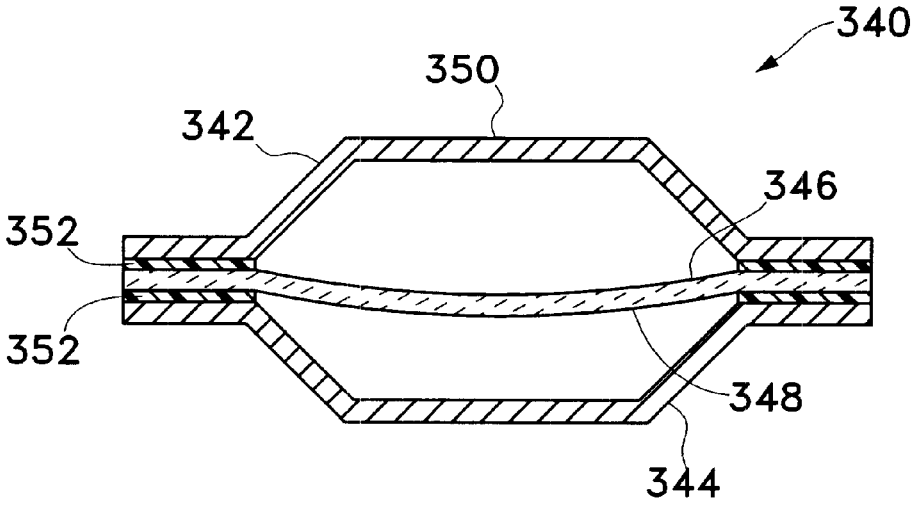
FIGS. 6A and 6B show respectively cross-section side views of variations of the inventive device having polymeric substrates.

FIG. 6A shows, in cross-section, side view, still another variation (340) of the inventive device. In this variation, the respective endcaps (342, 344) are depicted to be of the "cymbal" form as discussed above. However, they may be any of the endcap variations discussed above and elsewhere herein. The major variation from the others previously discussed is the use of a piezoelectric polymeric substrate (346). Piezoelectric substrate (346) may be made from a number of different known piezoelectric materials but preferably is polyvinylidenefluoride (PVDF), sold as Kynar. The polymer is typically shaped into a generally domed, perhaps hemispherical, central portion (348) which oscillates upon imposition of energy from the receiving plane region (350) to accentuate the amount of electrical energy created by the movement of the endcaps (342, 344). The central portion (348) of substrate (346) need not be dome-like; it may be flat as was the case with those ceramic and SCP substrates mentioned above, or it may have a shape approximating but not reaching that of hemisphericity. Substrate (346) is attached to the endcaps (342, 344) using adhesive or the like. The choice of material for joining substrate (348) to endcaps (342, 344) is broader in this variation than is the choice for those variations discussed earlier. A typical adhesive is depicted at (352) in FIG. 6A.

Figure 6B:
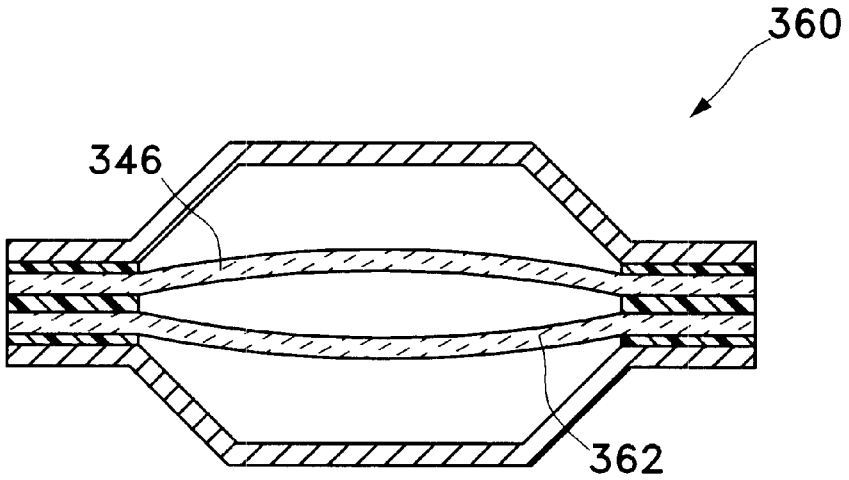

FIG. 6B shows another variation (360) of the inventive microphone. It is similar to the device discussed with regard to FIG. 6A, excepting that it has dual transducers (362) and (364) which are spaced apart from each other. Again, these transducer substrates (362, 364) are preferably provided with a generally permanent pre-form as shown in FIG. 6B, although the shape may vary as it is mechanically excited by the respective endcaps.

It should also be understood that the substrates shown in FIGS. 6A and 6B may alternatively be constructed of the non-polymeric materials mentioned above.

Figure 7A:
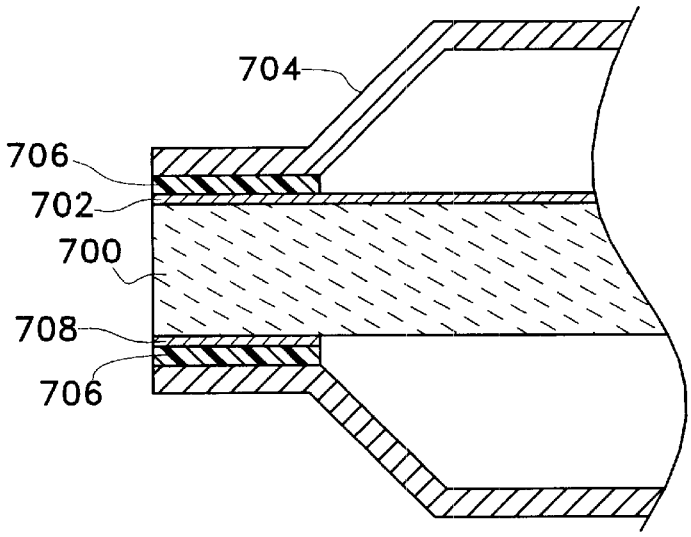
FIGS. 7A, 7B, and 7C show partial side-view cross-sections of representative methods of attaching the endcaps to the substrate.
Figure 7B:
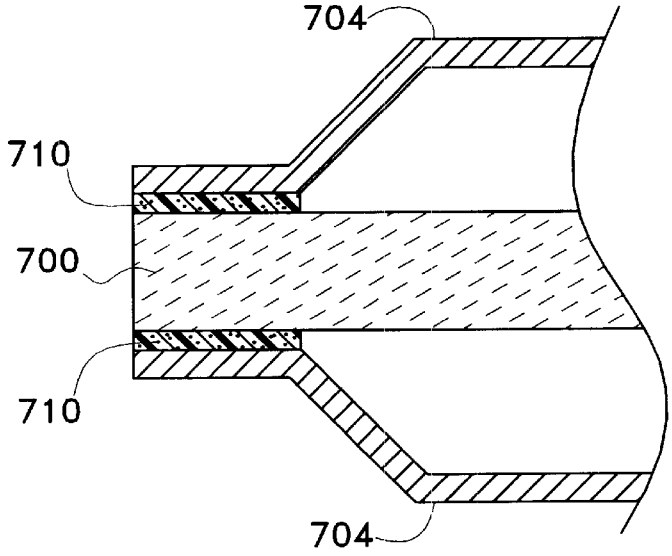
Figure 7C:
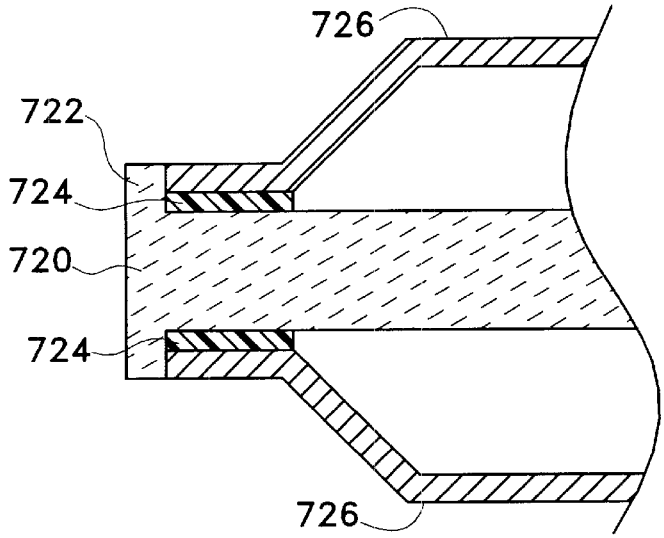

FIGS. 7A, 7B, and 7C all show close up, side view, partial cutaways of methods of attaching endcaps to the substrate. The collection of drawings is not all-inclusive; others will be similarly appropriate.

FIG. 7A shows a variation in which substrate (700) is covered by a conductive covering (702). Conductive covering (702) may be, e.g., sputtered metal, metals, or alloy, such as a member of the Platinum Group of the Periodic Table (Ru, Rh, Pd, Re, Os, Ir, and Pt) or gold. Titanium (Ti) is also especially suitable. Because of the nature of the substrates, it is often desirable to place these metals on the surface of the substrate by, e.g., sputtering, evaporation, plating or other deposition methods.

The combination of substrate (700) and sputtered coating (702) is then made to adhere to endcap (704) via, e.g., an adhesive (706). The adhesive (706) may be conductive, or not, as desired. Similarly, the endcap (704) may be used as a site for an electrical lead for that plane of the substrate (700), if such is desired. If the adhesive (706) is not conductive, the electrical signal would be taken from sputtered coating (702) and coating (708).

It should be noted that although conductive coating (702) is shown to extend across the complete surface of substrate (700), it is within the scope of this invention that the applied conductive metallic layer may be limited in size, such as is depicted by layer (708). In most instances, it is not critical that the conductive layers reach completely across substrate (700).

FIG. 7B shows a similar variation having substrate (700) and conductive adhesive (710) attaching the endcap (704) to the substrate (700). Conductive adhesive (710) may be conducted via the use of, e.g., powdered metals or the like in the adhesive mixture, or by use of inherently conductive materials. Again, this allows the use either of the adhesive itself (710) or the conductive endcaps (704) as sites for picking the signal generated by the piezoelectric substrate (700).

FIG. 7C shows a variation in which the substrate (720) has a partial outer lip (722) which can help to minimize radial movement of the endcaps (726) with relation to the substrate (720). It is very important that the lip configuration not be allowed to bind the overall movement of the substrate, however. In proper circumstances, i.e., that of a very tightly fitting endcap, the endcap may be used without adhesive.

Figure 8:
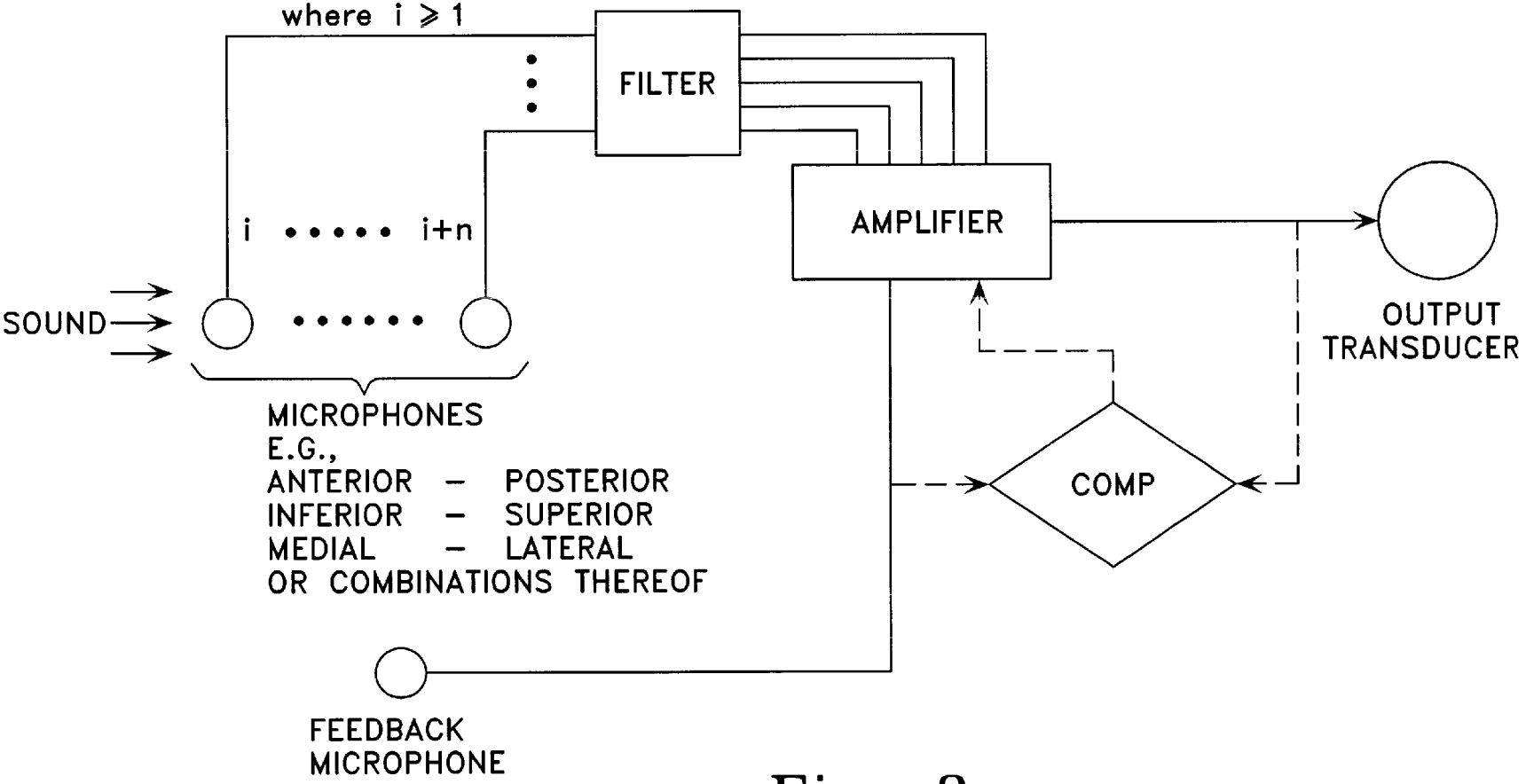
FIG. 8 shows a generalized schematic of a circuit which may be used with the inventive microphone devices.

FIG. 8 shows a generalized schematic of a circuit diagram for use of the inventive arrays in a preferred aided hearing device. The schematic corresponds to an array used either with a patient's right or left ears. At the top of the diagram is shown the presence of a generally linear array of at least two microphones (i and i+n, where n is at least 1). These microphones can also be arranged superior to inferior, or combinations of anterior-posterior, medial-lateral, and/or superior-inferior to gain the desired effect. These microphones intercept sound and because of the spatial relationship among them, are able to differentiate the direction from which sound is coming. For the sound shown in the top of FIG. 8, the lateral microphone hears the sound initially, the mid microphone hears it next, and the medial microphone hears it last. These differences are useful to the patient user. Ideally, the information from the microphones is passed through a filter. A filter may be chosen to correct or to minimize a number of ambient sounds not needed by the user. For instance, sharp sounds such as a hand scratching the microphone as that hand combs the user's hair may be filtered from the signal by a "pop" filter. In any event, the input from the microphones is fed into an amplifier. Similarly, output from a feedback microphone may be introduced into the amplifier. The feedback microphone generally is placed in the region of the human ear which re-emanates sound produced by the output transducer. In general, the output transducer may drive a bone in the human ear, as discussed below, which may in turn provide a physical drive to the eardrum. The eardrum would then act as a speaker cone on a high fidelity entertainment speaker, at such a level that it could be heard by one of the three lateral, mid, or medial microphones. In such an instance, "feedback" occurs and a large and undesirable squeal would be the result in the output transducer. The feedback microphone is placed in the human body in such a way that it "hears" the sound emanating from the body part (e.g., eardrum) and feeds it via a comparator into the amplifier to cancel the effect of the feedback.

These feedback elimination procedures are well known in the art and do not form a critical portion of this invention.

The so-adjusted output from the amplifier is then fed to the output transducer for introduction of amplified sound input into the ear.

FIGS. 9–12 show various desirable placements of the inventive microphones in the body, either alone or as a component of a system in the body.

Figure 9:
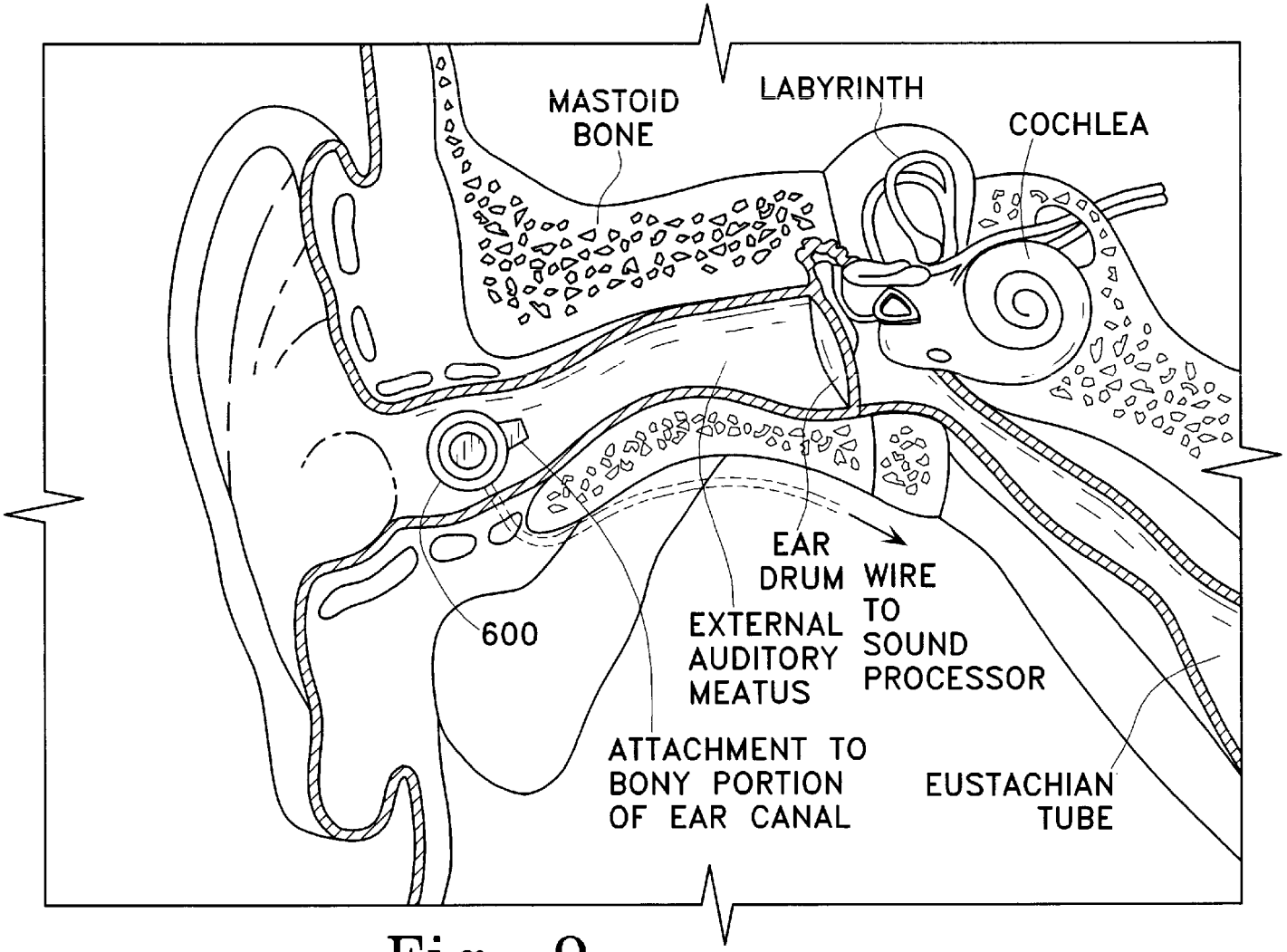
FIGS. 9–12 show placement of the inventive device within the ear structure.

In FIG. 9, the inventive microphone (600) (shown here in the so-called "cymbal" configuration) is placed in the external auditory meatus (ear canal) just medial to the concha. This portion of the ear canal has soft tissue and thus the cymbal preferably is anchored to the bony portion of the ear canal to prevent migration of the cymbal.

Figure 10:
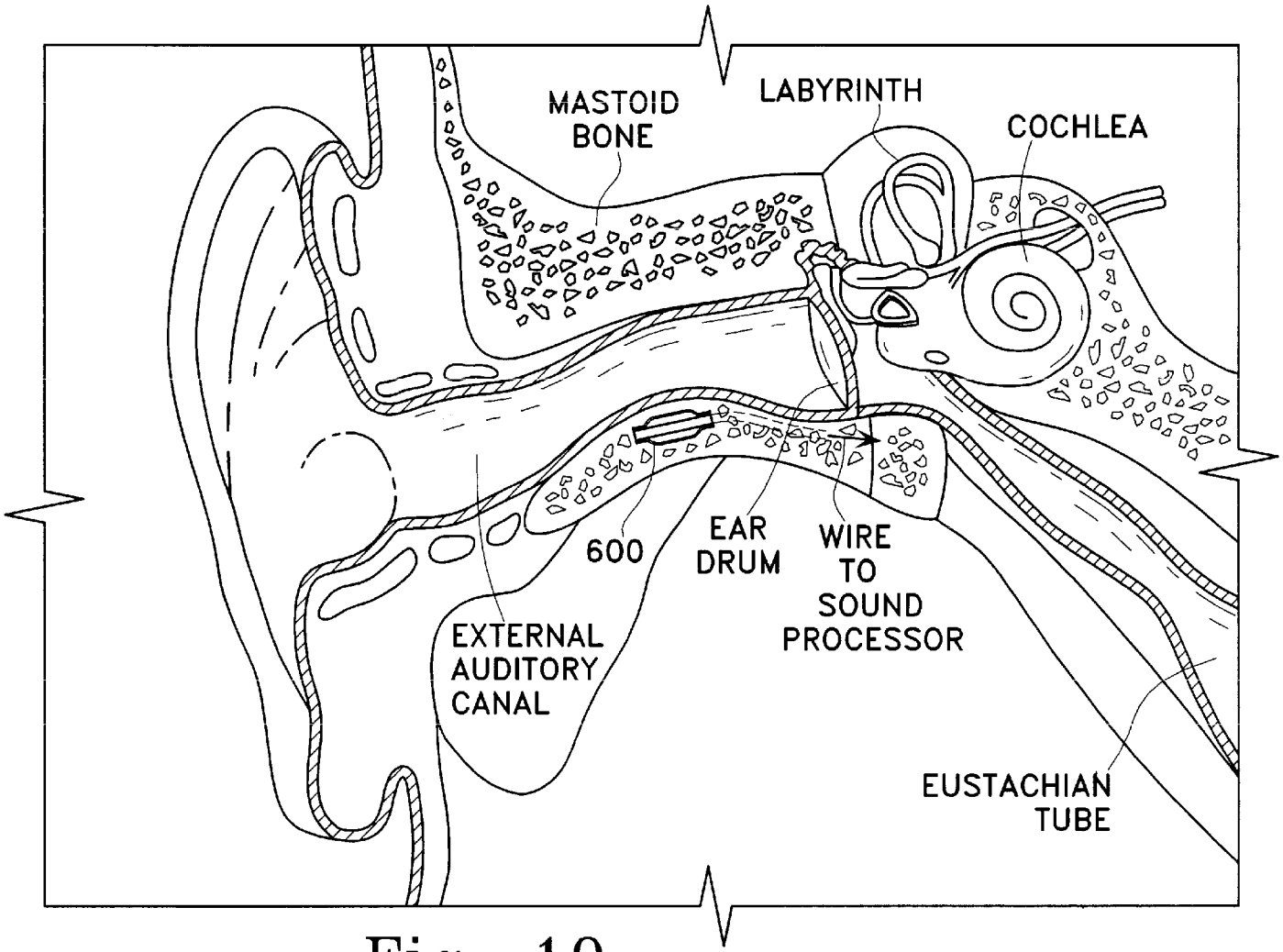

FIG. 10 shows the inventive microphone (600) at a more medial location in the ear canal. Here the inventive microphone (600) is placed within the bony portion of the ear canal. One endcap is buried in bone while the second endcap lies just under the skin. Alternatively, the cymbal could be made of a single endcap that lies under the ear-canal skin.

Figure 11:
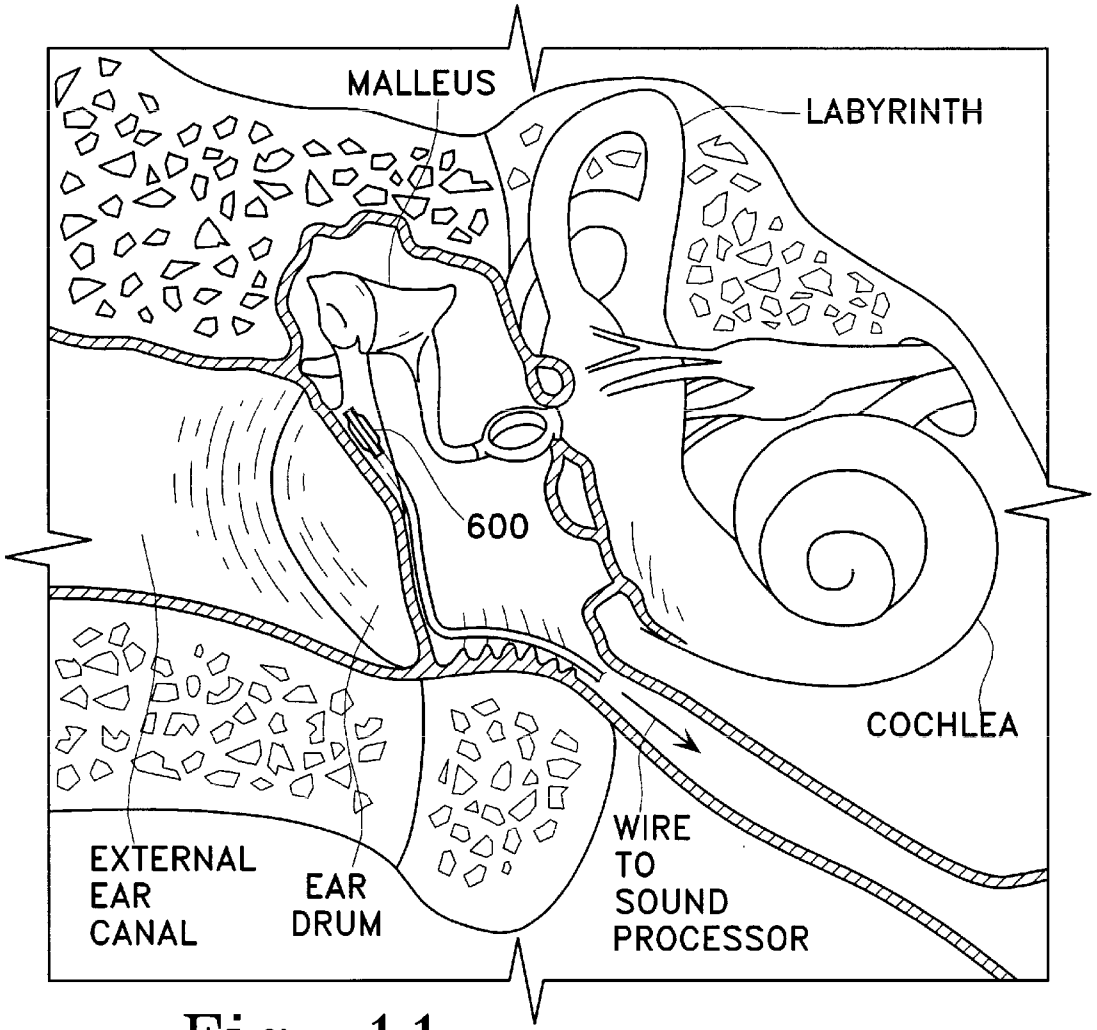

FIG. 11 shows the placement of the inventive microphone (600) beneath an elevated portion of the tympanic membrane. The fibrous layer that joins the eardrum and the malleus handle (superior to the umbo region), commonly referred to as the tympano-malleolar fold, has been separated to allow the introduction of the inventive microphone (600). The inventive microphone (600), in this instance, has been shaped to accommodate the malleus handle and is slipped between the eardrum and the malleus handle. Placement in this location is advantageous because in the forward direction (normal sound transmission) the cymbal is pressed against the high impedance bony handle. In the reverse direction, due to the sound emanating from the inner ear, the inventive microphone (600) will typically have the lower impedance tympanic membrane to push against. Thus, this placement of the cymbal microphone lowers the potential for acoustic feedback.

Figure 12:
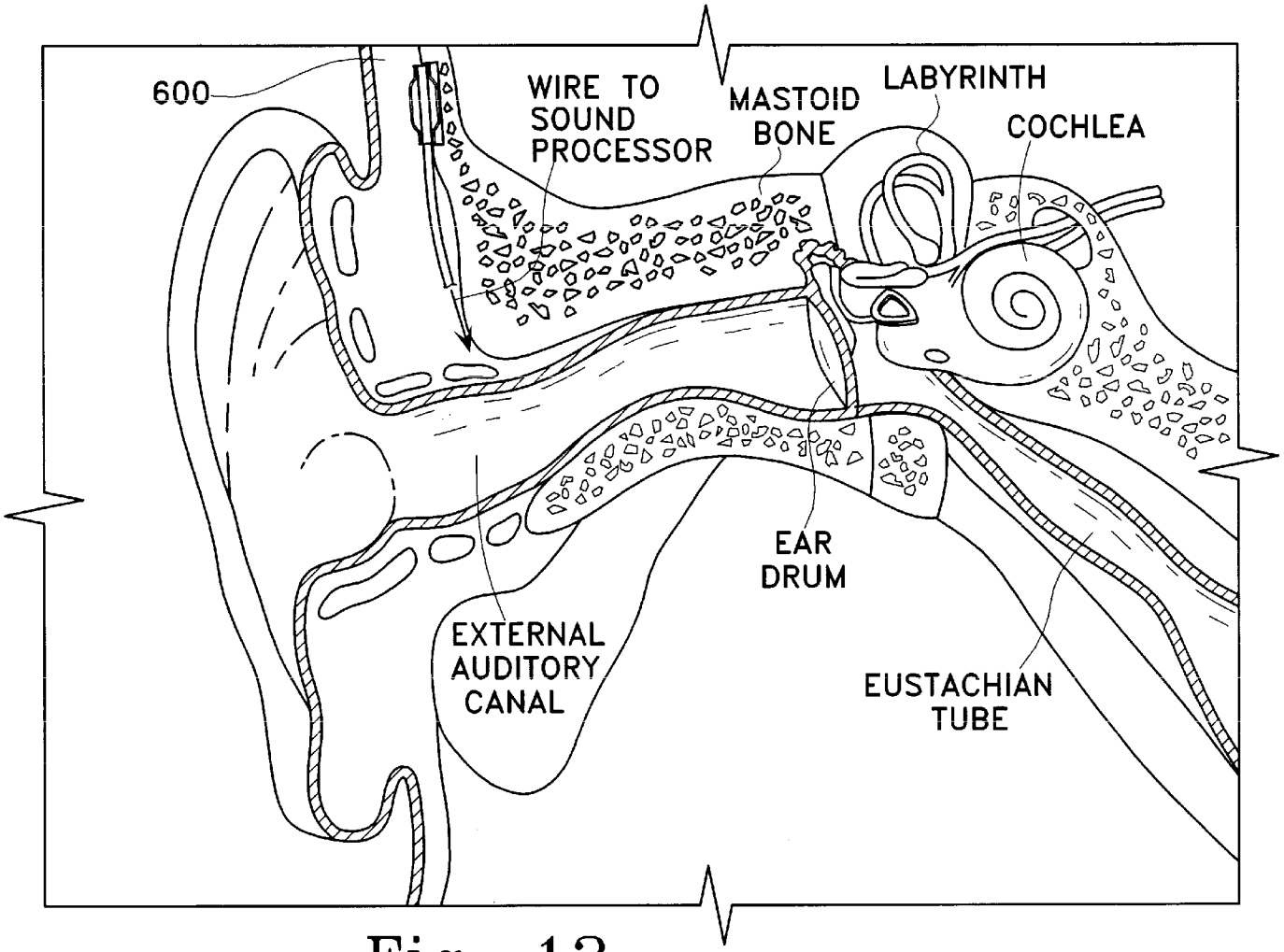

Clearly, when a microphone is implanted in the ear canal, there will be concern of feedback. Feedback could be reduced acoustically by creating a greater distance between the eardrum and the microphone. Such an arrangement is shown in FIG. 12. Here, the inventive microphone (600) is placed under the skin just above the helix of the pinna. A small indentation may be made in the bone (mastoid and/or squamous portion) to facilitate placement of the inventive microphone (600). The skin is then placed on the cymbal endcap and the wires arranged so that they are accessible by the electronics.

Figure 13:
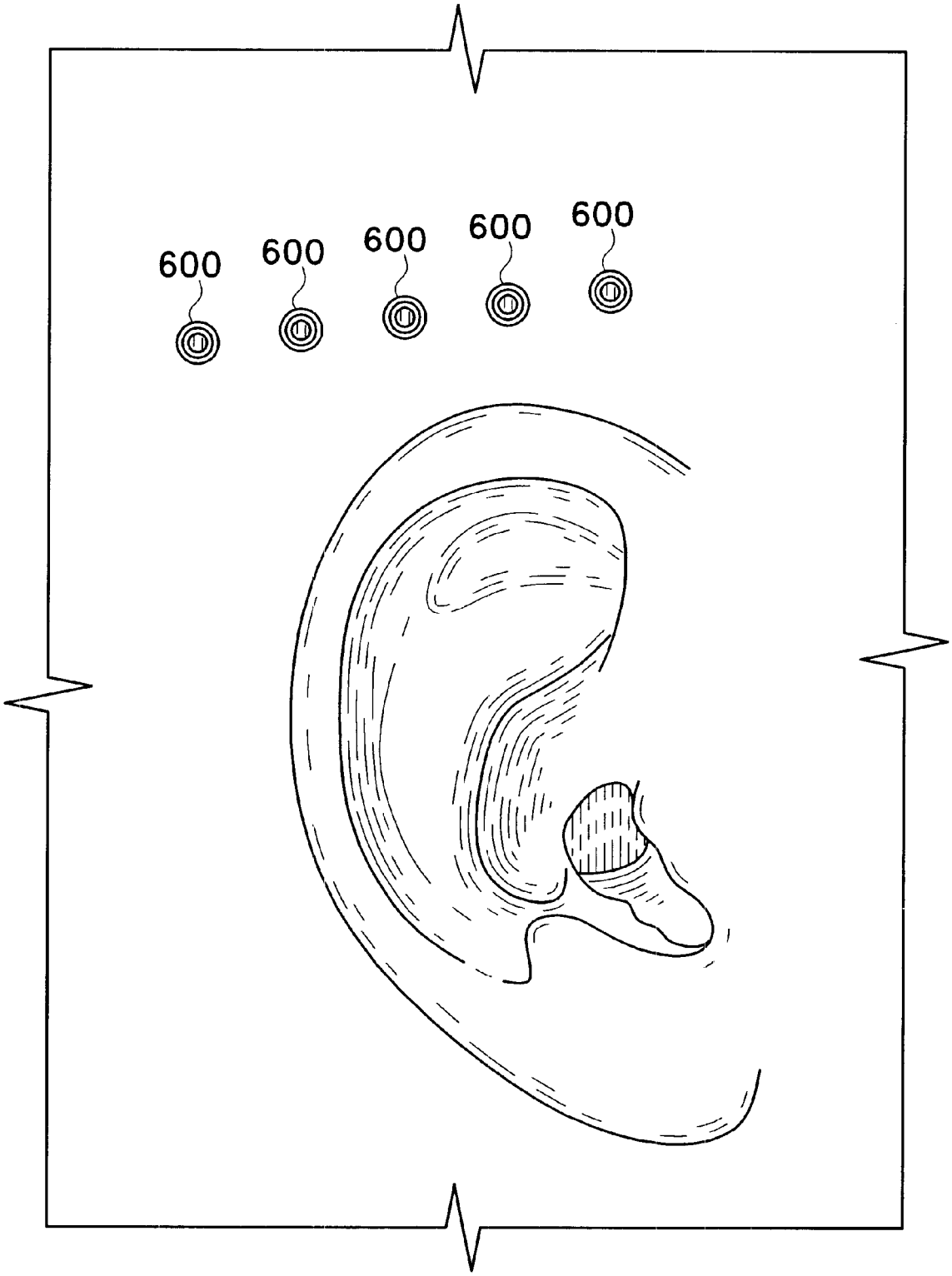
FIG. 13 shows exterior placement of an array of the inventive device.

An extension of the configuration shown in FIG. 12 is to place a plurality of the inventive microphones arranged in a linear array. Such a concept is illustrated in FIG. 13. A linear array of such microphones gives the designer an opportunity for providing directivity, or beam forming. Such an arrangement is important for increasing the signal-to-noise ratio. FIG. 13 shows five microphones placed approximately 1 cm apart. However, the number of microphones may be reduced for sound processing simplicity. With just two microphones and associated delay and electronics, it is possible to increase the SNR by approximately 4–5 dB while a SNR of 8–10 dB is achievable with an array of five microphones, See, e.g., Soede, above and Killion, M. C. (1997). "SNR Loss: 'I can hear what people say but I can't understand them'," *The Hearing Review* 4(12):8–14.

Although others have suggested the use of microphone arrays to increase SNR in hearing aids, it has not been practical due to the large size of the array (5–10 cm) needed to obtain significant improvement.

The most popular notion has been to put a microphone array on the side, or in front, of eye glasses. This microphone is then attached to a behind the ear (BTE), or an in the ear (ITE), hearing aid. But, for cosmetic reasons, such a configuration has never been popular. Placement of a subcutaneous array microphone circumvents cosmetic issues because the array is substantially invisible.

A shortcoming of microphones that are somewhat exposed, such as those shown in FIGS. 12 and 13, is that they are susceptible to spurious noises. For example, if the wearer brushes their hand against the skin overlying the microphone then a loud sound could be produced by the output actuator of the hearing aid, or equivalent electrical signals of a cochlear implant. However, by using multiple microphones (as shown in FIG. 13) it is possible to differentially detect and filter such spurious signals.

These placements of the inventive microphones may be used for detecting audible sounds by the steps of placing an inventive flextensional microphone that is at least partially covered with a biocompatible coating and subcutaneously implanted as shown just above in the path of an audible sound. This flextensional microphone then produces an electric signal which is related to the audible sound. The electrical signal coming from the microphones is amplified, as discussed above, to produce an amplified signal which is then sent to an output transducer which is desirably coupled to some component of the human ear. Further, the process may include the step of planting at least one of the flextensional microphones subcutaneously in the human body. Desirably, they are placed in an array, perhaps linear, at the side of the human head, perhaps below a layer of skin. A further step in the process may be the detection of sound re-radiated by some component of the human ear and producing a signal which is both related to the re-radiated sound and is in such a form that it may be used in an amplifier to minimize the feedback potentially present in the inventive system.

This invention has been described and specific examples of the invention have been portrayed. Use of those specific examples is not intended to limit the invention in any way. Additionally, to the extent that there are variations in the invention which are within the spirit of the disclosure and yet are equivalent to the inventions found in the claims, it is our intent that those claims cover those variations as well.

We claim as our invention:

1. An acousto-active device comprising:

a.) an acousto-active substrate having a pair of opposed first and second planar surfaces and a thickness, said substrate having a 3 direction orthogonal to said planar surfaces being defined by 1 and 2 directions parallel to said planar surfaces, and being comprised of an acousto-active material which generates a voltage across said planar surfaces when said substrate is stressed in at least one of said 1 and 2 directions, b.) at least one first stress-inducing member fixedly attached to said first of said opposed planar surfaces, said stress-inducing member inducing stress across at least one of said 1 and 2 directions when exposed to an acoustic pressure, c.) at least one second stress-inducing member fixedly attached to said second of said opposed planar surfaces, and d.) a biocompatible material isolating at least a portion of said first and second stress-inducing members.

2. The acousto-active device of claim 1 further comprising a voltage receiver for receiving said voltage generated across said planar surfaces when said at least one first stress-inducing member is exposed to said acoustic pressure.

3. The acousto-active device of claim 2 wherein said voltage receiver detects said voltage.

4. The acousto-active device of claim 2 wherein said voltage receiver comprises a A/D converter.

5. The acousto-active device of claim 2 wherein said voltage receiver comprises an amplifier.

6. The acousto-active device of claim 1 wherein said substrate is capable of producing a detectable voltage across said planar surfaces when said at least one first stress-inducing member is subjected to a sound in the audible frequency range of 100 Hz–10 kHz at levels of 40–120 dbSPL corresponding to a microphone sensitivity of 0.2–50 mV/Pa and a noise figure of less than 40 dB SPL.

7. The acousto-active device of claim 1 further comprising first and second electrically conductive electrodes each in contact with one of said opposed planar surfaces.

8. The acousto-active device of claim 7 wherein at least one of said first and second electrically conductive electrodes comprise a metal.

9. The acousto-active device of claim 8 wherein said metal is sputtered, painted, plated, or otherwise deposited on said substrate.

10. The acousto-active device of claim 8 wherein at least one of said first and second electrically conductive electrodes covers at least one of said first and second planar surfaces.

11. The acousto-active device of claim 8 wherein at least one of said first and second electrically conductive electrodes covers a portion of at least one of said first and second planar surfaces.

12. The acousto-active device of claim 7 wherein at least one of said first and second electrically conductive electrodes comprise a conductive polymer or polymer blend.

13. The acousto-active device of claim 1 wherein said first and second stress-inducing members further comprise electrically conductive electrodes.

14. The acousto-active device of claim 1 wherein said substrate is a single layer.

15. The acousto-active device of claim 14 wherein said acousto-active material is selected from the group consisting of PZT, PLZT, PMN, and PMN-PT.

16. The acousto-active device of claim 1 wherein said acousto-active material is multi-layered.

17. The acousto-active device of claim 16 wherein said acousto-active material is selected from the group consisting of PZT, PLZT, PMN, and PMN-PT.

18. The acousto-active device of claim 1 wherein said acousto-active material is a single crystal.

19. The acousto-active device of claim 18 wherein said acousto-active material is selected from the group consisting of PZT, PLZT, PMN, and PMN-PT.

20. The acousto-active device of claim 18 wherein said acousto-active material comprises a material selected from the group consisting of solid solutions of lead-zinc-niobate/lead titanate or lead-magnesium-niobate/lead titanate, described by the formulae: $Pb(Zn_{1/3}Nb_{2/3})_{1-x}\ Ti_xO_3$ or $Pb(Mg_{1/3}Nb_{2/3})_{1-y}\ Ti_yO_3$; where $0 \leqq x < 0.10$ and $0 \leqq y < 0.40$.

21. The acousto-active device of claim 1 wherein said acousto-active material is a piezoelectric polymer.

22. The acousto-active device of claim 21 wherein said piezoelectric polymer comprises PVDF.

23. The acousto-active device of claim 1 wherein said first stress-inducing member comprises a sound receiving diaphragm parallel to said first planar surface.

24. The acousto-active device of claim 23 wherein said first stress-inducing member further comprises a frusto-conical section having an outer lip fixedly attached to said first planar surface and said frusto-conical section fixedly attached to said sound receiving diaphragm.

25. The acousto-active device of claim 23 wherein said first stress-inducing member is generally circular and further comprises an arcuate cross-sectional section further having an outer lip fixedly attached to said first planar surface and said arcuate cross-sectional section fixedly attached to said sound receiving diaphragm.

26. The acousto-active device of claim 23 wherein said first stress-inducing member comprises at least two linear spacing members fixedly attached to said sound receiving diaphragm and attachment members fixedly attached to said first planar surface and wherein said linear spacing members separate said sound receiving diaphragm from said attachment members.

27. The acousto-active device of claim 1 wherein said second stress-inducing member comprises a sound receiving diaphragm parallel to said second planar surface.

28. The acousto-active device of claim 27 wherein said second stress-inducing member further comprises a frusto-conical section having an outer lip fixedly attached to said second planar surface and said frusto-conical section fixedly attached to said sound receiving diaphragm.

29. The acousto-active device of claim 27 wherein said second stress-inducing member further comprises an arcuate cross-sectional section further having an outer lip fixedly attached to said second planar surface and said arcuate cross-sectional section fixedly attached to said sound receiving diaphragm.

30. The acousto-active device of claim 27 wherein said first stress-inducing member comprises at least two linear spacing members fixedly attached to said sound receiving diaphragm and attachment members fixedly attached to said first planar surface and wherein said linear spacing members separate said sound receiving diaphragm from said attachment members.

31. The acousto-active device of claim 30 wherein said first and second stress-inducing members comprise an X-spring.

32. The acousto-active device of claim 1 wherein said substrate is generally circular.

33. The acousto-active device of claim 1 wherein said substrate has at least one linear side.

34. The acousto-active device of claim 1 wherein said substrate is rectangular.

35. The acousto-active device of claim 1 wherein said substrate is square.

36. The acousto-active device of claim 1 wherein said device is in an array of microphones.

37. The acousto-active device of claim 1 wherein said array of microphones is linear.

38. The acousto-active device of claim 1 wherein said biocompatible material isolating at least a portion of said first and second stress-inducing members comprises a polymer or metal.

39. The acousto-active device of claim 38 wherein said biocompatible material comprises a member selected from the group consisting of titanium, titanium oxide, gold, platinum, and vitreous carbon.

40. The acousto-active device of claim 1 wherein said biocompatible material isolating at least a portion of said first and second stress-inducing members comprises a polymeric, metallic, or composite bag.

41. A flex-tensional acousto-active device comprising:

a.) at least one acousto-active substrate in flex-tension, said at least one substrate being domed and having a pair of opposed first and second surfaces and a thickness, and being comprised of an acousto-active material which generates a voltage across said surfaces when said substrate is stressed, b.) at least one first stress-inducing member fixedly attached to said first of said opposed surfaces, said stress-inducing member inducing stress across at least one of said at least one acousto-active substrates when exposed to an acoustic pressure, c.) at least one second stress-inducing member fixedly attached to said second of said opposed surfaces, and d.) a biocompatible material isolating at least a portion of said first and second stress-inducing members.

42. The acousto-active device of claim 41 further comprising a voltage receiver for receiving said voltage generated across said planar surfaces when said at least one first stress-inducing member is exposed to said acoustic pressure.

43. The acousto-active device of claim 42 wherein said voltage receiver detects said voltage.

44. The acousto-active device of claim 42 wherein said voltage receiver comprises a A/D converter.

45. The acousto-active device of claim 42 wherein said voltage receiver comprises an amplifier.

46. The acousto-active device of claim 41 wherein said substrate is capable of producing a detectable voltage across said planar surfaces when said at least one first stress-inducing member is subjected to a sound in the audible frequency range of 100 Hz–10 kHz at levels of 40–120 db SPL corresponding to a microphone sensitivity of 0.2–50 mV/Pa and a noise figure of less than 40 db SPL.

47. The acousto-active device of claim 41 further comprising first and second electrically conductive electrodes each in contact with one of said opposed planar surfaces.

48. The acousto-active device of claim 47 wherein at least one of said first and second electrically conductive electrodes comprise a metal.

49. The acousto-active device of claim 48 wherein said metal is sputtered, evaporated, painted, plated, or otherwise deposited on said substrate.

50. The acousto-active device of claim 48 wherein at least one of said first and second electrically conductive electrodes covers at least one of said first and second planar surfaces.

51. The acousto-active device of claim 48 wherein at least one of said first and second electrically conductive electrodes covers a portion of at least one of said first and second planar surfaces.

52. The acousto-active device of claim 47 wherein at least one of said first and second electrically conductive electrodes comprise a conductive polymer or polymer blend.

53. The acousto-active device of claim 41 wherein said first and second stress-inducing members further comprise electrically conductive electrodes.

54. The acousto-active device of claim 41 wherein said substrate is a dome.

55. The acousto-active device of claim 41 comprising at least two spaced apart domes.

56. The acousto-active device of claim 55 wherein said acousto-active material is selected from the group consisting of PZT, PLZT, PMN, and PMN-PT.

57. The acousto-active device of claim 55 wherein said acousto-active material comprises a material selected from the group consisting of solid solutions of lead-zinc-niobate/lead titanate or lead-magnesium-niobate/lead titanate, described by the formulae: $Pb(Zn_{1/3}Nb_{2/3})_{1-x}\ Ti_xO_3$ or $Pb(Mg_{1/3}Nb_{2/3})_{1-y}\ Ti_yO_3$; where $0 \leqq x < 0.10$ and $0 \leqq y < 0.40$.

58. The acousto-active device of claim 54 wherein said acousto-active material is selected from the group consisting of PZT, PLZT, PMN, and PMN-PT.

59. The acousto-active device of claim 54 wherein said acousto-active material comprises a material selected from the group consisting of solid solutions of lead-zinc-niobate/lead titanate or lead-magnesium-niobate/lead titanate, described by the formulae: $Pb(Zn_{1/3}Nb_{2/3})_{1-x}\ Ti_xO_3$ or $Pb(Mg_{1/3}Nb_{2/3})_{1-y}\ Ti_yO_3$; where $0 \leqq x < 0.10$ and $0 \leqq y < 0.40$.

60. The acousto-active device of claim 41 wherein said acousto-active material is a piezoelectric polymer.

61. The acousto-active device of claim 60 wherein said piezoelectric polymer comprises PVDF.

62. The acousto-active device of claim 41 wherein said first stress-inducing member comprises a sound receiving diaphragm parallel to said first planar surface.

63. The acousto-active device of claim 62 wherein said first stress-inducing member further comprises a frusto-conical section having an outer lip fixedly attached to said first planar surface and said frusto-conical section fixedly attached to said sound receiving diaphragm.

64. The acousto-active device of claim 62 wherein said first stress-inducing member is generally circular and further comprises an arcuate cross-sectional section further having an outer lip fixedly attached to said first planar surface and said arcuate cross-sectional section fixedly attached to said sound receiving diaphragm.

65. The acousto-active device of claim 62 wherein said first stress-inducing member comprises at least two linear spacing members fixedly attached to said sound receiving diaphragm and attachment members fixedly attached to said first planar surface and wherein said linear spacing members separate said sound receiving diaphragm from said attachment members.

66. The acousto-active device of claim 41 wherein said second stress-inducing member comprises a sound receiving diaphragm parallel to said second planar surface.

67. The acousto-active device of claim 66 wherein said second stress-inducing member further comprises a frusto-conical section having an outer lip fixedly attached to said second planar surface and said frusto-conical section fixedly attached to said sound receiving diaphragm.

68. The acousto-active device of claim 66 wherein said second stress-inducing member further comprises an arcuate cross-sectional section further having an outer lip fixedly attached to said second planar surface and said arcuate cross-sectional section fixedly attached to said sound receiving diaphragm.

69. The acousto-active device of claim 66 wherein said first stress-inducing member comprises at least two linear spacing members fixedly attached to said sound receiving diaphragm and attachment members fixedly attached to said first planar surface and wherein said linear spacing members separate said sound receiving diaphragm from said attachment members.

70. The acousto-active device of claim 41 wherein said device is in an array of microphones.

71. The acousto-active device of claim 41 wherein said array of microphones is linear.

72. The acousto-active device of claim 41 wherein said biocompatible material isolating at least a portion of said first and second stress-inducing members comprises a polymer or metal.

73. The acousto-active device of claim 41 wherein said biocompatible material isolating at least a portion of said first and second stress-inducing members comprises a polymeric, metallic, or composite bag.

* * * * *